US009578415B1

(12) United States Patent
Zhou et al.

(10) Patent No.: US 9,578,415 B1
(45) Date of Patent: Feb. 21, 2017

(54) HYBRID ADAPTIVE NOISE CANCELLATION SYSTEM WITH FILTERED ERROR MICROPHONE SIGNAL

(71) Applicant: Cirrus Logic International Semiconductor Ltd., Edinburgh (GB)

(72) Inventors: Dayong Zhou, Austin, TX (US); Yang Lu, Cedar Park, TX (US); Ning Li, Cedar Park, TX (US); Nitin Kwatra, Austin, TX (US); Antonio J. Miller, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 14/832,585

(22) Filed: Aug. 21, 2015

(51) Int. Cl.
*H04R 3/00* (2006.01)
*G10K 11/178* (2006.01)
*G10K 11/16* (2006.01)

(52) U.S. Cl.
CPC ..... *H04R 3/002* (2013.01); *G10K 11/178* (2013.01); *G10K 11/16* (2013.01); *G10K 2210/108* (2013.01); *G10K 2210/1081* (2013.01); *G10K 2210/1082* (2013.01); *G10K 2210/3017* (2013.01); *G10K 2210/3022* (2013.01); *G10K 2210/3026* (2013.01); *G10K 2210/3027* (2013.01); *G10K 2210/3035* (2013.01); *G10K 2210/3039* (2013.01); *G10K 2210/3055* (2013.01); *G10K 2210/3056* (2013.01); *G10K 2210/509* (2013.01)

(58) Field of Classification Search
CPC ..... H04R 3/002; G10K 11/178; G10K 11/16; G10K 2210/509; G10K 2210/108; G10K 2210/1081; G10K 2210/1082; G10K 2210/3017;G10K 2210/3022; G10K 2210/3026; G10K 2210/3027; G10K 2210/3035; G10K 2210/3039; G10K 2210/3055; G10K 2210/3056
See application file for complete search history.

(56) References Cited

U.S. PATENT DOCUMENTS

| | | | |
|---|---|---|---|
| 5,117,401 | A | 5/1992 | Feintuch |
| 5,251,263 | A | 10/1993 | Andrea et al. |
| 5,278,913 | A | 1/1994 | Delfosse et al. |
| 5,321,759 | A | 6/1994 | Yuan |
| 5,337,365 | A | 8/1994 | Hamabe et al. |
| 5,359,662 | A | 10/1994 | Yuan et al. |

(Continued)

FOREIGN PATENT DOCUMENTS

| | | | |
|---|---|---|---|
| CN | 101552939 | A | 10/2009 |
| DE | 102011013343 | A1 | 9/2012 |

(Continued)

OTHER PUBLICATIONS

Kou, Sen and Tsai, Jianming, Residual noise shaping technique for active noise control systems, J. Acoust. Soc. Am. 95 (3), Mar. 1994, pp. 1665-1668.

(Continued)

*Primary Examiner* — Brenda Bernardi
(74) *Attorney, Agent, or Firm* — Jackson Walker L.L.P.

(57) ABSTRACT

In accordance with systems and methods of the present disclosure, an adaptive noise cancellation system may include an alignment filter configured to correct misalignment of a reference microphone signal and an error microphone signal by generating a misalignment correction signal.

32 Claims, 8 Drawing Sheets

(56) References Cited

U.S. PATENT DOCUMENTS 5,377,276 A 12/1994 Terai et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,559,893 A 9/1996 Krokstad
5,586,190 A 12/1996 Trantow et al.
5,633,795 A 5/1997 Popovich
5,640,450 A 6/1997 Watanabe
5,668,747 A 9/1997 Ohashi
5,696,831 A 12/1997 Inanaga
5,699,437 A 12/1997 Finn
5,706,344 A 1/1998 Finn
5,740,256 A 4/1998 Castello Da Costa et al.
5,768,124 A 6/1998 Stothers et al.
5,809,152 A 9/1998 Nakamura et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,185,300 B1 2/2001 Romesburg
6,219,427 B1 4/2001 Kates et al.
6,278,786 B1 8/2001 McIntosh
6,282,176 B1 8/2001 Hemkumar
6,317,501 B1 11/2001 Matsuo
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,110,864 B2 9/2006 Restrepo et al.
7,181,030 B2 2/2007 Rasmussen et al.
7,330,739 B2 2/2008 Somayajula
7,365,669 B1 4/2008 Melanson
7,368,918 B2 5/2008 Henson et al.
7,406,179 B2 7/2008 Ryan
7,441,173 B2 10/2008 Restrepo et al.
7,466,838 B1 12/2008 Moseley
7,555,081 B2 6/2009 Keele, Jr.
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,155,334 B2 4/2012 Joho et al.
8,249,262 B2 8/2012 Chua et al.
8,254,589 B2 8/2012 Mitsuhata
8,290,537 B2 10/2012 Lee et al.
8,325,934 B2 12/2012 Kuo
8,363,856 B2 1/2013 Lesso
8,374,358 B2 2/2013 Buck et al.
8,379,884 B2 2/2013 Horibe et al.
8,401,200 B2 3/2013 Tiscareno et al.
8,411,872 B2 * 4/2013 Stothers ..... G05B 13/042 381/71.11
8,442,251 B2 5/2013 Jensen et al.
8,526,627 B2 9/2013 Asao et al.
8,532,310 B2 9/2013 Gauger, Jr. et al.
8,539,012 B2 9/2013 Clark
8,804,974 B1 8/2014 Melanson
8,848,936 B2 9/2014 Kwatra et al.
8,907,829 B1 12/2014 Naderi
8,908,877 B2 12/2014 Abdollahzadeh Milani et al.
8,909,524 B2 12/2014 Stoltz et al.
8,942,976 B2 1/2015 Li et al.
8,948,407 B2 2/2015 Alderson et al.
8,948,410 B2 2/2015 Van Leest
8,958,571 B2 2/2015 Kwatra et al.
8,977,545 B2 3/2015 Zeng et al.
9,020,160 B2 4/2015 Gauger, Jr.
9,066,176 B2 6/2015 Hendrix et al.
9,082,391 B2 7/2015 Yermeche et al.
9,094,744 B1 7/2015 Lu et al.
9,106,989 B2 8/2015 Li et al.
9,107,010 B2 8/2015 Abdollahzadeh Milani et al.
9,203,366 B2 12/2015 Eastty
9,264,808 B2 2/2016 Zhou et al.
9,294,836 B2 3/2016 Zhou et al.
9,392,364 B1 * 7/2016 Milani ..... H04R 3/002
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0001450 A1 1/2004 He et al.
2004/0047464 A1 3/2004 Yu et al.
2004/0120535 A1 6/2004 Woods
2004/0165736 A1 8/2004 Hetherington et al.
2004/0167777 A1 8/2004 Hetherington et al.
2004/0176955 A1 9/2004 Farinelli, Jr.
2004/0196992 A1 10/2004 Ryan
2004/0202333 A1 10/2004 Csermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0175187 A1 * 8/2005 Wright ..... G10K 11/1782 381/71.12
2005/0207585 A1 9/2005 Christoph
2005/0240401 A1 10/2005 Ebenezer
2006/0013408 A1 1/2006 Lee
2006/0018460 A1 1/2006 McCree
2006/0035593 A1 2/2006 Leeds
2006/0055910 A1 3/2006 Lee
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0208520 A1 9/2007 Zhang et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240413 A1 10/2008 Mohammed et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.

(56) References Cited

U.S. PATENT DOCUMENTS

2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0226210 A1 9/2010 Kordis et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0272284 A1 10/2010 Joho et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0316225 A1 12/2010 Saito et al.
2010/0322430 A1 12/2010 Isberg
2011/0007907 A1 1/2011 Park et al.
2011/0026724 A1 2/2011 Doclo
2011/0091047 A1 4/2011 Konchitsky et al.
2011/0096933 A1 4/2011 Eastty
2011/0099010 A1 4/2011 Zhang
2011/0106533 A1 5/2011 Yu
2011/0116643 A1 5/2011 Tiscareno
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0057720 A1 3/2012 Van Leest
2012/0084080 A1 4/2012 Konchitsky et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1 7/2012 Alves et al.
2012/0179458 A1 7/2012 Oh et al.
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Karnath et al.
2012/0308027 A1 12/2012 Kwatra
2012/0308028 A1 12/2012 Kwatra et al.
2012/0310640 A1 12/2012 Kwatra et al.
2012/0316872 A1 12/2012 Stoltz et al.
2013/0010982 A1 1/2013 Elko et al.
2013/0083939 A1 4/2013 Fellers et al.
2013/0156238 A1 6/2013 Birch et al.
2013/0243198 A1 9/2013 Van Rumpt
2013/0243225 A1 9/2013 Yokota
2013/0259251 A1 10/2013 Bakalos
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301846 A1 11/2013 Alderson et al.
2013/0301847 A1 11/2013 Alderson et al.
2013/0301848 A1 11/2013 Zhou et al.
2013/0301849 A1 11/2013 Alderson
2013/0315403 A1 11/2013 Samuelsson
2013/0343556 A1 12/2013 Bright
2013/0343571 A1 12/2013 Rayala et al.
2014/0044275 A1 2/2014 Goldstein et al.
2014/0050332 A1 2/2014 Nielsen et al.
2014/0051483 A1 2/2014 Schoerkmaier
2014/0072134 A1 3/2014 Po et al.
2014/0072135 A1 3/2014 Bajic et al.
2014/0086425 A1 3/2014 Jensen et al.
2014/0126735 A1 5/2014 Gauger, Jr.
2014/0169579 A1 6/2014 Azmi
2014/0177851 A1 6/2014 Kitazawa et al.
2014/0177890 A1 6/2014 Hojlund et al.
2014/0211953 A1 7/2014 Alderson et al.
2014/0226827 A1 8/2014 Abdollahzadeh Milani et al.
2014/0270222 A1 9/2014 Hendrix et al.
2014/0270223 A1 9/2014 Li et al.
2014/0270224 A1 9/2014 Zhou et al.
2014/0294182 A1 10/2014 Axelsson
2014/0307887 A1 10/2014 Alderson
2014/0307888 A1 10/2014 Alderson et al.
2014/0307890 A1 10/2014 Zhou et al.
2014/0307899 A1 10/2014 Hendrix et al.
2014/0314244 A1 10/2014 Yong et al.
2014/0314246 A1 10/2014 Hellman
2014/0314247 A1 10/2014 Zhang
2014/0341388 A1 11/2014 Goldstein
2014/0369517 A1 12/2014 Zhou et al.
2015/0078572 A1 3/2015 Milani et al.
2015/0092953 A1 4/2015 Abdollahzadeh Milani et al.
2015/0104032 A1 4/2015 Kwatra et al.
2015/0161980 A1 6/2015 Alderson et al.
2015/0161981 A1 6/2015 Kwatra
2015/0163592 A1 6/2015 Alderson
2015/0256660 A1 9/2015 Kaller et al.
2015/0256953 A1 9/2015 Kwatra et al.
2015/0269926 A1 9/2015 Alderson et al.
2015/0365761 A1 12/2015 Alderson et al.
2016/0180830 A1 6/2016 Lu et al.

FOREIGN PATENT DOCUMENTS

EP 0412902 A2 2/1991
EP 0756407 A2 1/1997
EP 0898266 A2 2/1999
EP 1691577 A2 8/2006
EP 1880699 A2 1/2008
EP 1947642 A1 7/2008
EP 2133866 A1 12/2009
EP 2237573 A1 10/2010
EP 2216774 A1 8/2011
EP 2395500 A1 12/2011
EP 2395501 A1 12/2011
EP 2551845 A1 1/2013
EP 2583074 A1 4/2013
GB 2401744 A 11/2004
GB 246657 A 10/2007

(56) References Cited

FOREIGN PATENT DOCUMENTS

| | | | |
|---|---|---|---|
| GB | 2455821 | A | 6/2009 |
| GB | 2455824 | A | 6/2009 |
| GB | 2455828 | A | 6/2009 |
| GB | 2484722 | A | 4/2012 |
| JP | 06006246 | | 1/1994 |
| JP | H06186985 | A | 7/1994 |
| JP | H06232755 | | 8/1994 |
| JP | 07098592 | | 4/1995 |
| JP | H0732558 | A | 12/1995 |
| JP | H11305783 | A | 11/1999 |
| JP | 2000089770 | | 3/2000 |
| JP | 2002010355 | | 1/2002 |
| JP | 2004007107 | | 1/2004 |
| JP | 2006217542 | A | 8/2006 |
| JP | 2007060644 | | 3/2007 |
| JP | 2008015046 | A | 1/2008 |
| JP | 2010277025 | | 12/2010 |
| JP | 2011061449 | | 3/2011 |
| WO | 9911045 | | 3/1999 |
| WO | 03015074 | A1 | 2/2003 |
| WO | 03015275 | A1 | 2/2003 |
| WO | 2004009007 | A1 | 1/2004 |
| WO | 2004017303 | A1 | 2/2004 |
| WO | 2006125061 | A1 | 11/2006 |
| WO | 2006128768 | A1 | 12/2006 |
| WO | 2007007916 | A1 | 1/2007 |
| WO | 2007011337 | A1 | 1/2007 |
| WO | 2007110807 | A2 | 10/2007 |
| WO | 2007113487 | A1 | 11/2007 |
| WO | 2009041012 | A1 | 4/2009 |
| WO | 2009110087 | A1 | 9/2009 |
| WO | 2010117714 | A1 | 10/2010 |
| WO | 2011035061 | A1 | 3/2011 |
| WO | 2012107561 | A1 | 8/2012 |
| WO | 2012119808 | A2 | 9/2012 |
| WO | 2012134874 | A1 | 10/2012 |
| WO | 2012166273 | A2 | 12/2012 |
| WO | 2012166388 | A1 | 12/2012 |
| WO | 2013106370 | A1 | 7/2013 |
| WO | 2014158475 | A1 | 10/2014 |
| WO | 2014168685 | A1 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088639 | A1 | 6/2015 |
| WO | 2015088651 | A | 6/2015 |
| WO | 2015088651 | A1 | 6/2015 |
| WO | 2015088653 | A1 | 6/2015 |
| WO | 2015134225 | A1 | 9/2015 |
| WO | 2015191691 | A1 | 12/2015 |
| WO | 2016100602 | A1 | 6/2016 |

OTHER PUBLICATIONS

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Toochinda, et al., "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMB Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

Davari, et al., "A New Online Secondary Path Modeling Method for Feedforward Active Noise Control Systems," IEEE International Conference on Industrial Technology, Apr. 21-24, 2008, pp. 1-6, Chengdu, China.

Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.

Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.

Booji, P.S., Berkhoff, A.P., Virtual sensors for local, three dimensional, broadband multiple-channel active noise control and the effects on the quiet zones, Proceedings of ISMA2010 including USD2010, pp. 151-166, Aug. 26-31, 2010.

Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech, Jun. 2011.

D. Senderowicz et al., "Low-Voltage Double-Sampled Delta-Sigma Converters," IEEE J. Solid-State Circuits, vol. 32,, No. 12, pp. 1907-1919, Dec. 1997, 13 pages.

Hurst, P.J. and Dyer, K.C., "An improved double sampling scheme for switched-capacitor delta-sigma modulators," IEEE Int. Symp. Circuits Systems, May 1992, vol. 3, pp. 1179-1182, 4 pages.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

Cohen, et al., "Noise Estimation by Minima Controlled Recursive Averaging for Robust Speech Enhancement", IEEE Signal Processing Letters, vol. 9, No. 1, Jan. 2002.

Martin, "Noise Power Spectral Density Estimation Based on Optimal Smoothing and Minimum Statistics", IEEE Trans. on Speech and Audio Processing, col. 9, No. 5, Jul. 2001.

Martin, "Spectral Subtraction Based on Minimum Statistics", Proc. 7th EUSIPCO '94, Edinburgh, U.K., Sep. 13-16, 1994, pp. 1182-1195.

Cohen, "Noise Spectrum Estimation in Adverse Environments: Improved Minima Controlled Recursive Averaging", IEEE Trans. on Speech & Audio Proc., vol. 11, Issue 5, Sep. 2003.

Black, John W., "An Application of Side-Tone in Subjective Tests of Microphones and Headsets", Project Report No. NM 001 064. 01.20, Research Report of the U.S. Naval School of Aviation Medicine, Feb. 1, 1954, 12 pages (pp. 1-12 in pdf), Pensacola, FL, US.

(56) References Cited

OTHER PUBLICATIONS

Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA,US.
Liu, et al., "Compensatory Responses to Loudness-shifted Voice Feedback During Production of Mandarin Speech", Journal of the Acoustical Society of America, Oct. 2007, pp. 2405-2412, vol. 122, No. 4.
Paepcke, et al., "Yelling in the Hall: Using Sidetone to Address a Problem with Mobile Remote Presence Systems", Symposium on User Interface Software and Technology, Oct. 16-19, 2011, 10 pages. (pp. 1-10 in pdf), Santa Barbara, CA, US.
Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.
Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphhones-with-noise-cancellation-tech.
International Patent Application No. PCT/US2014/017096, International Search Report and Written Opinion, May 27, 2014, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 12 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
International Patent Application No. PCT/US2014/049600, International Search Report and Written Opinion, Jan. 14, 2015, 12 pages.
International Patent Application No. PCT/US2014/061753, International Search Report and Written Opinion, Feb. 9, 2015, 8 pages.
Combined Search and Examination Report, Application No. GB1512832.5, mailed Jan. 28, 2016, 7 pages.
International Patent Application No. PCT/US2015/066260, International Search Report and Written Opinion, Apr. 21, 2016, 13 pages.
English machine translation of JP 2006-217542 A (Okumura, Hiroshi; Howling Suppression Device and Loudspeaker, published Aug. 2006).
Combined Search and Examination Report, Application No. GB1519000.2, mailed Apr. 21, 2016, 5 pages.
Parkins, et al., Narrowband and broadband active control in an enclosure using the acoustic energy density, J. Acoust. Soc. Am. Jul. 2000, pp. 192-203, vol. 108, issue 1, U.S.
International Patent Application No. PCT/US2015/022113, International Search Report and Written Opinion, Jul. 23, 2015, 13 pages.
International Patent Application No. PCT/US2014/061548, International Search Report and Written Opinion, Feb. 12, 2015, 13 pages.
International Patent Application No. PCT/US2014/060277, International Search Report and Written Opinion, Mar. 9, 2015, 11 pages.
Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
International Patent Application No. PCT/US2014/017112, International Search Report and Written Opinion, May 8, 2015, 22 pages.
International Patent Application No. PCT/US2015/017124, International Search Report and Written Opinion, Jul. 13, 2015, 19 pages.
International Patent Application No. PCT/US2015/035073, International Search Report and Written Opinion, Oct. 8, 2015, 11 pages.

* cited by examiner

HYBRID ADAPTIVE NOISE CANCELLATION SYSTEM WITH FILTERED ERROR MICROPHONE SIGNAL

FIELD OF DISCLOSURE

The present disclosure relates in general to adaptive noise cancellation in connection with an acoustic transducer, and more particularly, to a hybrid adaptive noise cancellation system with a filtered error microphone signal to correct for misalignment between a reference microphone signal and an error microphone signal caused by a feedback filter of the hybrid adaptive noise cancellation system.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

In many noise cancellation systems, it is desirable to include both feedforward noise cancellation by using a feedforward adaptive filter for generating a feedforward anti-noise signal from a reference microphone signal configured to measure ambient sounds and feedback noise cancellation by using a fixed-response feedback filter for generating a feedback noise cancellation signal to be combined with the feedforward anti-noise signal. However, using traditional approaches, when a gain of the feedback path is strong, the response of the feedforward adaptive filter may diverge, thus rendering the adaptive system unstable.

SUMMARY

In accordance with the teachings of the present disclosure, the disadvantages and problems associated with instability of existing approaches for implementing hybrid adaptive noise cancellation may be reduced or eliminated.

In accordance with embodiments of the present disclosure, a integrated circuit for implementing at least a portion of a personal audio device may include an output for providing a signal to a transducer including both a source audio signal for playback to a listener and an anti-noise signal for countering the effect of ambient audio sounds in an acoustic output of the transducer, a reference microphone input for receiving a reference microphone signal indicative of the ambient audio sounds, an error microphone input for receiving an error microphone signal indicative of the output of the transducer and the ambient audio sounds at the transducer; and a processing circuit. The processing circuit may implement a feedforward filter having a response that generates at least a portion of the anti-noise signal from the reference microphone signal, a secondary path estimate filter configured to model an electro-acoustic path of the source audio signal and have a response that generates a secondary path estimate from the source audio signal, a feedback filter having a response that generates at least a portion of the anti-noise signal based on the error microphone signal, an alignment filter configured to correct misalignment of the reference microphone signal and error microphone signal by generating a misalignment correction signal; a feedforward coefficient control block that shapes the response of the feedforward filter by adapting the response of the feedforward filter to minimize the ambient audio sounds in the error microphone signal; and a secondary path coefficient control block that shapes the response of the secondary path estimate filter in conformity with the source audio signal and the misalignment correction signal in order to minimize the misalignment correction signal.

In accordance with these and other embodiments of the present disclosure, a method for canceling ambient audio sounds in the proximity of a transducer of a personal audio device may include receiving a reference microphone signal indicative of the ambient audio sounds, receiving an error microphone signal indicative of the output of the transducer and the ambient audio sounds at the transducer, generating a source audio signal for playback to a listener, generating a feedforward anti-noise signal component from the reference microphone signal by adapting a response of an adaptive filter that filters the reference microphone signal to minimize the ambient audio sounds in the error microphone signal, generating a feedback anti-noise signal component based on the error microphone signal for countering the effects of ambient audio sounds at an acoustic output of the transducer, generating a misalignment correction signal to correct misalignment of the reference microphone signal and error microphone signal, generating the secondary path estimate from the source audio signal by adapting a response of a secondary path estimate filter that models an electro-acoustic path of the source audio signal and filters the source audio signal to minimize the filtered playback corrected error, and combining the feedforward anti-noise signal component and the feedback anti-noise signal component with a source audio signal to generate an audio signal provided to the transducer.

In accordance with these and other embodiments of the present disclosure, an integrated circuit for implementing at least a portion of a personal audio device may include an output for providing a signal to a transducer including both a source audio signal for playback to a listener and an anti-noise signal for countering the effect of ambient audio sounds in an acoustic output of the transducer, a reference microphone input for receiving a reference microphone signal indicative of the ambient audio sounds, an error microphone input for receiving an error microphone signal indicative of the output of the transducer and the ambient audio sounds at the transducer, a noise input for receiving an injected, substantially inaudible noise signal, and a processing circuit. The processing circuit may implement a feedforward filter having a response that generates at least a portion of the anti-noise signal from the reference microphone signal, a secondary path estimate filter configured to model an electro-acoustic path of the source audio signal and have a response that generates a secondary path estimate from the source audio signal, a feedback filter having a response that generates at least a portion of the anti-noise signal based on the error microphone signal, an effective secondary estimate filter configured to model an electro-acoustic path of the anti-noise signal and have a response that generates the filtered noise signal from the noise signal, a feedforward coefficient control block that shapes the response of the feedforward filter in conformity with the error microphone signal and the reference microphone signal by adapting the response of the feedforward filter to minimize the ambient audio sounds in the error microphone signal, a secondary path coefficient control block that shapes the response of the effective secondary path estimate filter in conformity with the noise signal and the error microphone signal in order to minimize the playback corrected error, and a secondary estimate construction block that generates the response of the secondary estimate filter from the response of the effective secondary estimate filter.

In accordance with these and other embodiments of the present disclosure, a method for canceling ambient audio sounds in the proximity of a transducer of a personal audio device may include receiving a reference microphone signal indicative of the ambient audio sounds, receiving an error microphone signal indicative of an output of the transducer and the ambient audio sounds at the transducer, generating a source audio signal for playback to a listener, generating a feedforward anti-noise signal component from the reference microphone signal by adapting a response of an adaptive filter that filters the reference microphone signal to minimize the ambient audio sounds in the error microphone signal, generating a feedback anti-noise signal component based on the error microphone signal, generating the filtered noise signal from a noise signal by adapting a response of an effective secondary path estimate filter that models an electro-acoustic path of the anti-noise signal and filters the noise signal to minimize the error microphone signal, generating the secondary path estimate from the source audio signal by applying a response of a secondary path estimate filter wherein the response of the secondary estimate filter is generated from the response of the effective secondary estimate filter, and combining the feedforward anti-noise signal component and the feedback anti-noise signal component with a source audio signal to generate an audio signal provided to the transducer.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment, and an error microphone may be included for controlling the adaptation of the anti-noise signal to cancel the ambient audio sounds and for correcting for the electro-acoustic path from the output of the processing circuit through the transducer.

Figure 1A:
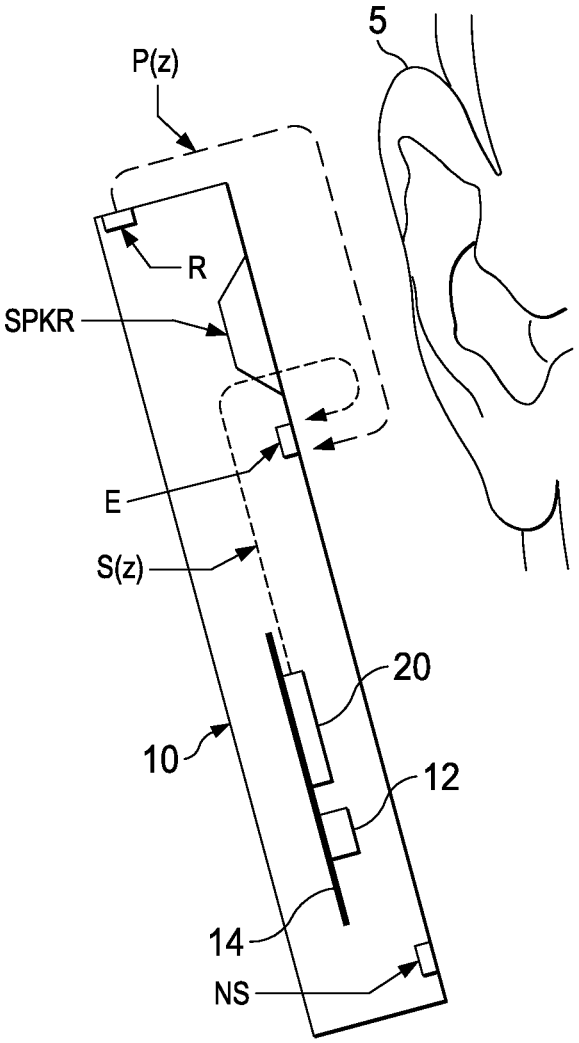
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the claims. Wireless telephone 10 may include a transducer, such as speaker SPKR, that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In different embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes.

Figure 1B:
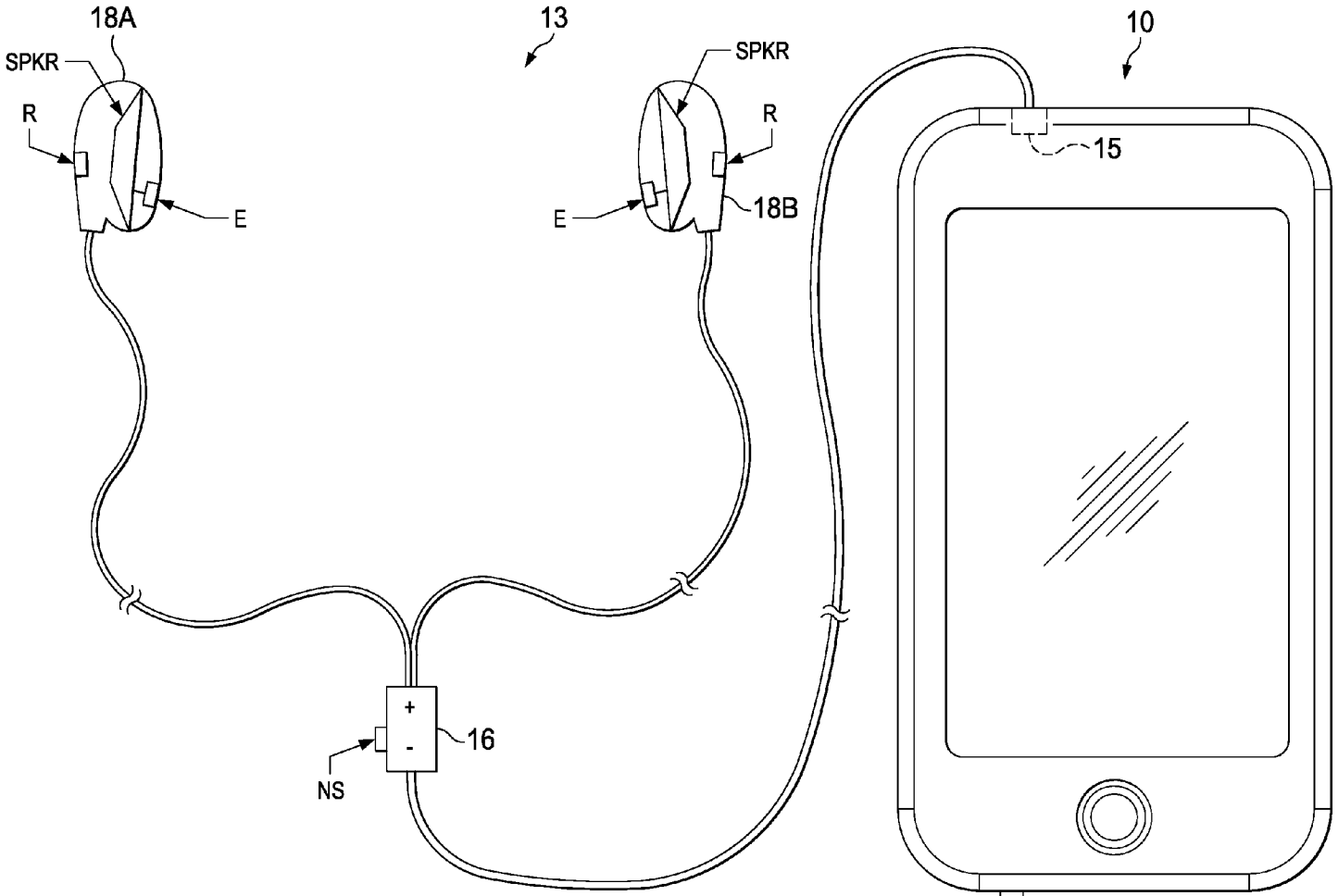
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone," may refer to intra-concha earphones, supra-concha earphones, and supra-aural earphones.

Combox 16 or another portion of headphone assembly 13 may have a near-speech microphone NS that may capture near-end speech in addition to or in lieu of near-speech microphone NS of wireless telephone 10. In addition, each headphone 18A, 18B may include a transducer, such as speaker SPKR, that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications, such as a low battery indication and other system event notifications. Each headphone 18A, 18B may include a reference microphone R for measuring the ambient acoustic environment and an error microphone E for measuring of the ambient audio combined with the audio reproduced by speaker SPKR close a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
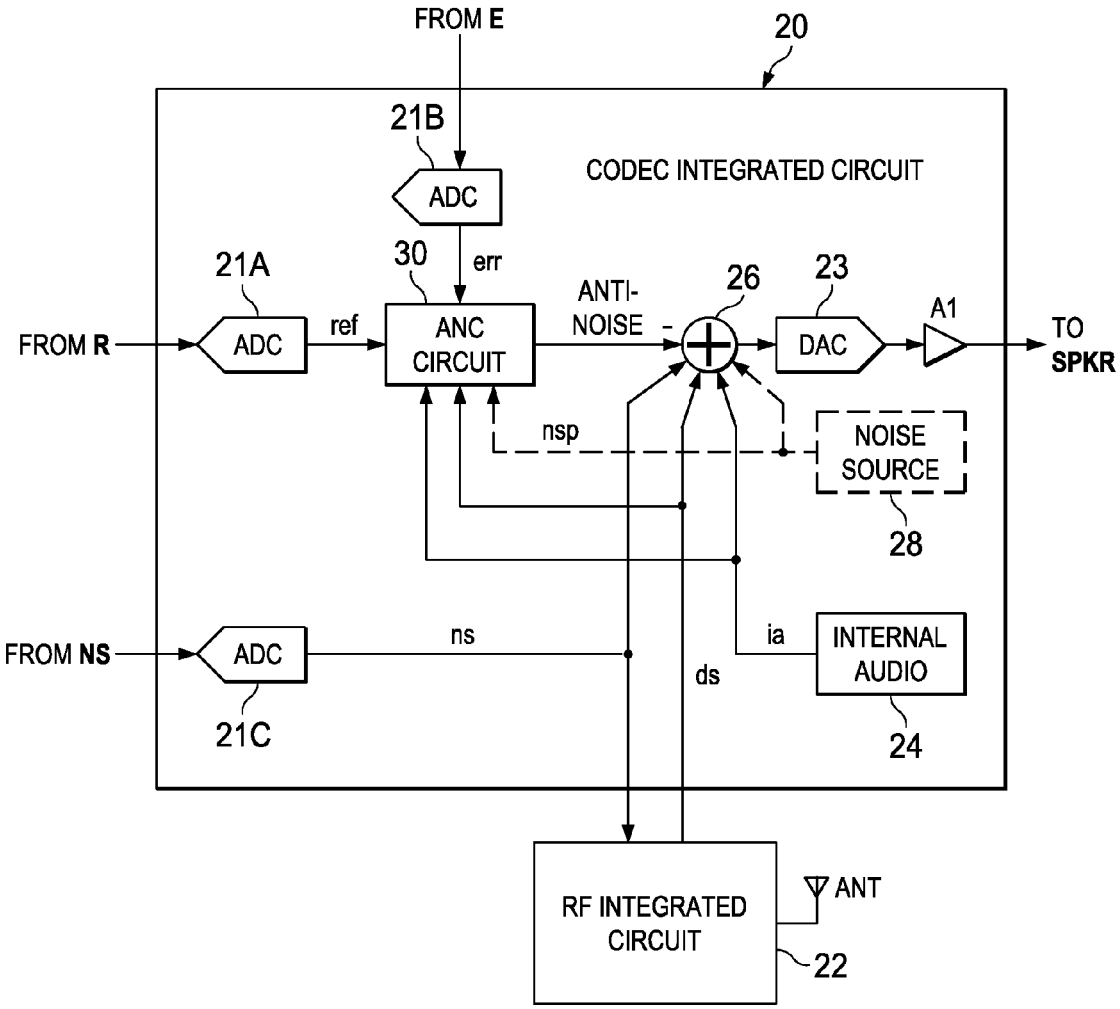
FIG. 2 is a block diagram of selected circuits within the wireless telephone depicted in FIG. 1A, in accordance with embodiments of the present disclosure.

Referring now to FIG. 2, selected circuits within wireless telephone 10 are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT. In some embodiments, combiner 26 may also combine a substantially inaudible noise signal nsp (e.g., a noise signal with low magnitude and/or in frequency ranges outside the audible band) generated from a noise source 28.

Figure 3A:
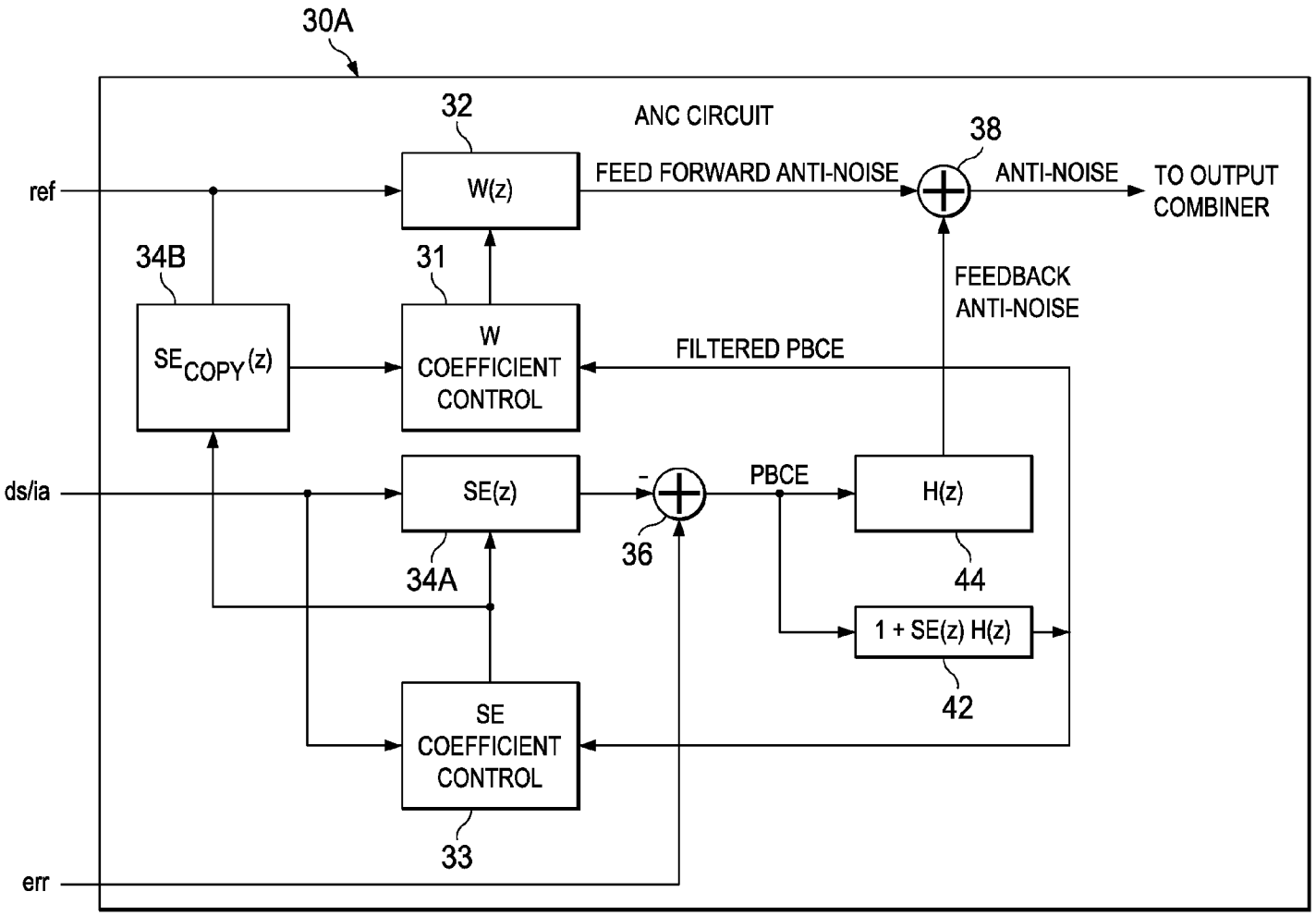
FIGS. 3A-3D are each a block diagram depicting selected signal processing circuits and functional blocks within an example active noise canceling (ANC) circuit of a coder-decoder (CODEC) integrated circuit of FIG. 2, in accordance with embodiments of the present disclosure.

Referring now to FIG. 3A, details of ANC circuit 30A are shown in accordance with embodiments of the present disclosure. ANC circuit 30A may be used in some embodiments to implement ANC circuit 30 depicted in FIG. 2. As shown in FIG. 3A, adaptive filter 32 may receive reference microphone signal ref and under ideal circumstances, may adapt its transfer function W(z) to be P(z)/S(z) to generate a feedforward anti-noise component of the anti-noise signal, which may be combined by combiner 38 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err as shaped by an alignment filter 42, as described in greater detail below. By transforming reference microphone signal ref with a copy of the estimate of the response of path S(z), response $SE_{COPY}(z)$, and minimizing the ambient audio sounds in the error microphone signal, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err. However, by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36 to generate a playback-corrected error (shown as PBCE in FIG. 3A) which may be filtered by alignment filter 42 to generate a misalignment correction signal, which may comprise a filtered playback-corrected error, as described in greater detail below. SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As depicted in FIG. 3A, ANC circuit 30 may also comprise feedback filter 44. Feedback filter 44 may receive the playback corrected error signal PBCE and may apply a response H(z) to generate a feedback anti-noise component of the anti-noise signal based on the playback corrected error which may be combined by combiner 38 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

As mentioned above, ANC circuit 30A may also include an alignment filter 42. In the presence of feedback filter 44, an effective secondary path $S_{eff}(z)$ for adaptive filter 32 may be given by $S_{eff}(z)=S(z)/[1+H(z)S(z)]$, and a playback-corrected error $PBCE_{FB}(z)$ with feedback filter 44 present (e.g., $H(z)\neq 0$) may be different than a playback-corrected error signal PBCE(z) without feedback filter 44 present (e.g., H(z)=0), as may be given by $Err_{FB}=Err(z)/[1+H(z)S(z)]$. Accordingly, in the absence of alignment filter 42 (e.g., if playback corrected error PBCE was not filtered by alignment filter 42 and was fed directly into W coefficient control 31 and SE coefficient control 33), the reference microphone signal ref and the playback corrected error PBCE may not be aligned, but may differ by a phase angle of 1/[1+H(z)S(z)]. Thus, alignment filter 42 may be configured to correct such misalignment of reference microphone signal ref, error microphone signal err, the source audio signal, and the playback-corrected error by generating a filtered playback-corrected error (shown as "filtered PB CE" in FIG. 3A) from playback-corrected error PBCE. As shown in FIG. 3A, alignment filter 42 may have a response given by 1+SE(z) H(z).

Figure 3B:
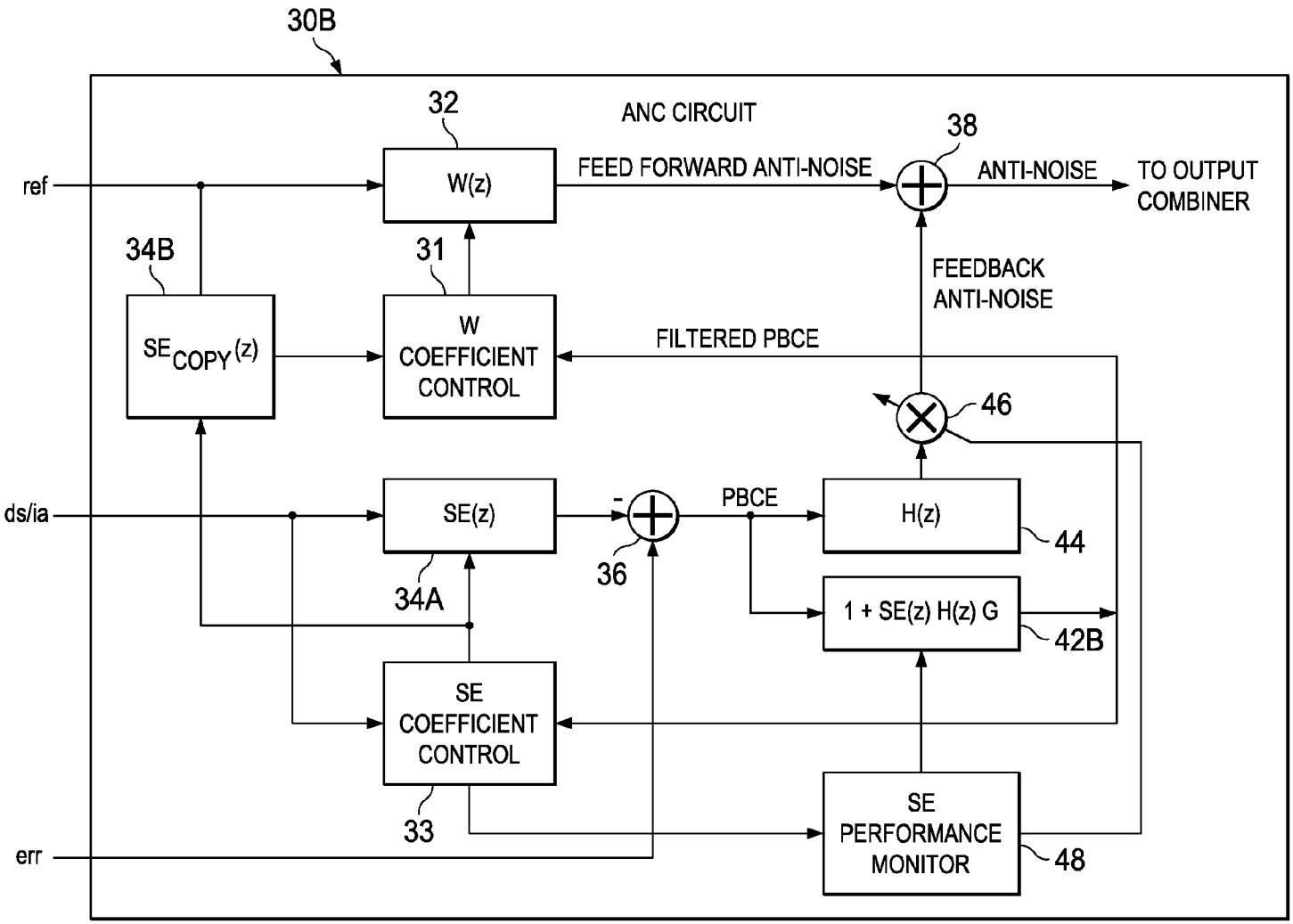

Referring now to FIG. 3B, details of ANC circuit 30B are shown in accordance with embodiments of the present disclosure. ANC circuit 30B may be used in some embodiments to implement ANC circuit 30 depicted in FIG. 2. ANC circuit 30B may be similar in many respects to ANC circuit 30A, thus only the differences between ANC circuit 30B and ANC circuit 30A are discussed.

As depicted in FIG. 3B, a path of the feedback anti-noise component may have a programmable gain element 46 with a programmable gain G, such that an increased gain G will cause increased noise cancellation of the feedback anti-noise component, and decreasing the gain G will cause reduced noise cancellation of the feedback anti-noise component. Although feedback filter 44 and gain element 46 are shown as separate components of ANC circuit 30B, in some embodiments some structure and/or function of feedback filter 44 and gain element 46 may be combined. For example, in some of such embodiments, an effective gain of feedback filter 44 may be varied via control of one or more filter coefficients of feedback filter 44.

In addition, in ANC circuit 30B, an alignment filter 42B may be implemented in place of alignment filter 42 of ANC circuit 30A, such that alignment filter 42B may have a response 1+SE(z)H(z)G that accounts for any misalignment between reference microphone signal ref and error microphone signal err caused by feedback filter 44 and programmable gain element 46 that would be introduced into ANC circuit 30B if alignment filter 42B were not present (e.g., if playback corrected error PBCE was not filtered by alignment error 42 and was fed directly into W coefficient control 31 and SE coefficient control 33).

As shown in FIG. 3B, ANC circuit 30 may also comprise secondary path estimate performance monitor 48. Secondary path estimate performance monitor 48 may comprise any system, device, or apparatus configured to give an indication of how efficiently secondary path estimate adaptive filter 34A is modeling the electro-acoustic path of the source audio signal over various frequencies, as determined by the efficiency by which secondary path estimate adaptive filter 34A causes combiner 36 to remove the source audio signal from the error microphone signal in generating the playback-corrected error over various frequencies.

Responsive to a determination by a secondary path estimate performance monitor 48 that secondary path estimate adaptive filter 34A is not sufficiently modeling the electro-acoustic path of the source audio signal, secondary path estimate performance monitor 48 may control gain element 46 and alignment filter 42B to reduce gain G, and then increase gain G when secondary path estimate adaptive filter 34A is sufficiently modeling the electro-acoustic path. Thus, when secondary path estimate adaptive filter 34A is not well-trained, secondary path estimate performance monitor 48 may reduce gain G and train secondary path estimate adaptive filter 34A. Once secondary path estimate adaptive filter 34A is well-trained, secondary path estimate performance monitor 48 may increase gain G and then update secondary path estimate adaptive filter 34A and/or adaptive filter 32.

To determine whether or not secondary path estimate adaptive filter 34A is not sufficiently modeling the electro-acoustic path of the source audio signal, secondary path estimate performance monitor 48 may calculate a secondary index performance index (SEPI) defined as:

$$SEPI = \sum_{i=k}^{n} |SE(i)|$$

where k represents a first coefficient tap of secondary path estimate adaptive filter 34A and n represents a second coefficient tap of secondary path estimate adaptive filter 34A. In some embodiments, the coefficient taps will comprise the coefficient taps representing the longest delay elements of a finite impulse response filter that implements secondary path estimate adaptive filter 34A. For example, in a 256-coefficient filter, k may equal 128 and n may equal 256. Once calculated, the value of SEPI may be compared to one or more threshold values to determine if secondary path estimate adaptive filter 34A is sufficiently modeling the electro-acoustic path of the source audio signal. If the SEPI value is below such a threshold, secondary path estimate adaptive filter 34A may be determined to be sufficiently modeling the electro-acoustic path of the source audio signal Referring now to FIG. 3C, details of ANC circuit 30C are shown in accordance with embodiments of the present disclosure. ANC circuit 30C may be used in some embodiments to implement ANC circuit 30 depicted in FIG. 2. ANC circuit 30C may be similar in many respects to ANC circuit 30B, thus only the differences between ANC circuit 30C and ANC circuit 30B are discussed.

Figure 3C:
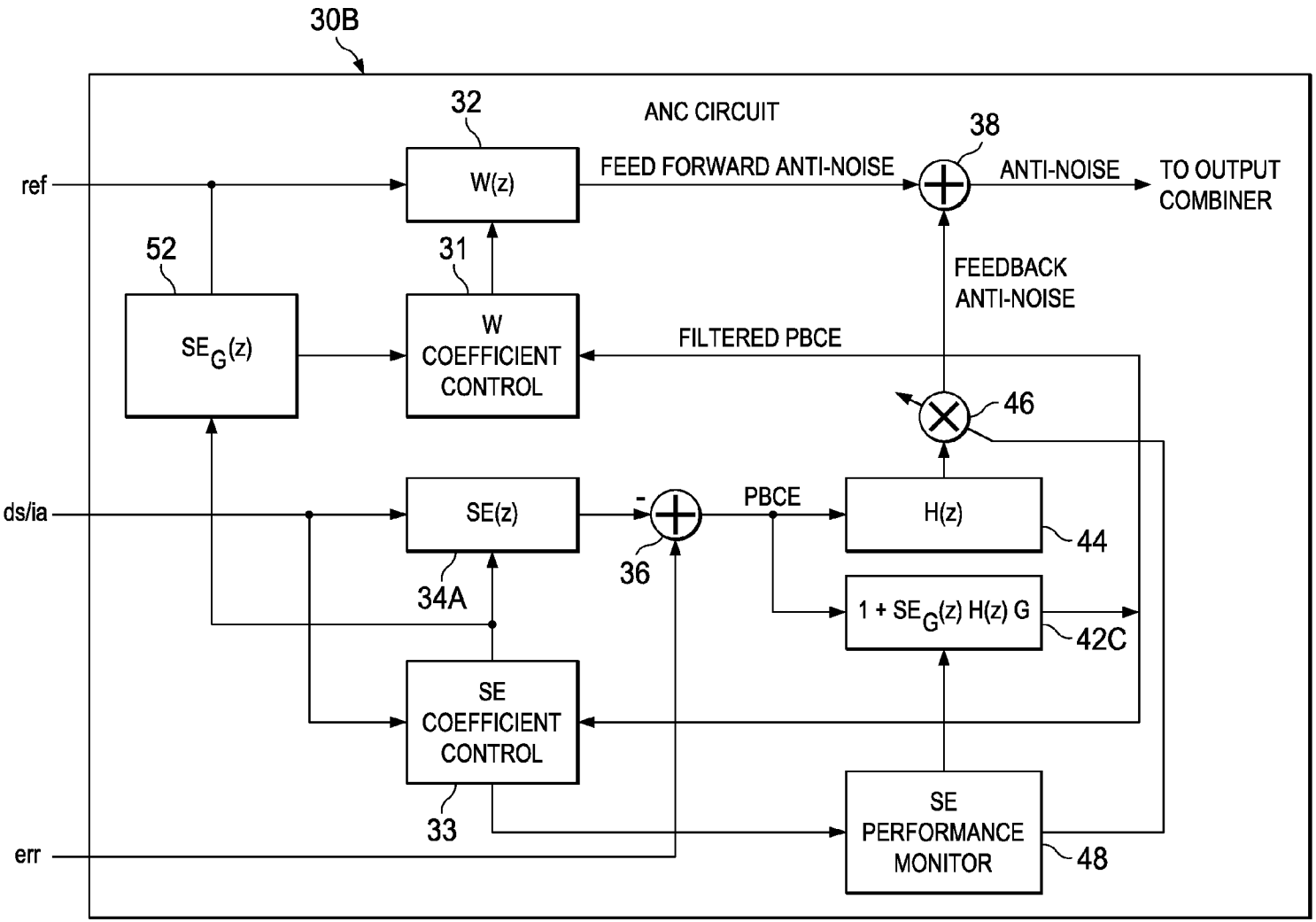

As shown in FIG. 3C, alignment filter 42C may be used in lieu of alignment filter 42B shown in FIG. 3B, wherein the difference is that alignment filter 42C may apply a response $1+SE_G(z)H(z)G$, which represents a previously-stored known-good response of secondary path estimate adaptive filter 34A existing at a time when, as determined by secondary path estimate performance monitor 48, secondary path estimate filter 34A was sufficiently modeling the electro-acoustic path of the source audio signal. In addition, filter 34B may be replaced by a filter 52 having a response $SE_G(z)$.

In operation, when secondary path estimate performance monitor 48 determines that secondary path estimate filter 34A is sufficiently modeling the electro-acoustic path of the source audio signal, secondary path estimate performance monitor 48 may cause the response $SE_G(z)$ to be updated with the response SE(z) on a periodic basis. On the other hand, when secondary path estimate performance monitor 48 determines that secondary path estimate filter 34A is not sufficiently modeling the electro-acoustic path of the source audio signal, secondary path estimate performance monitor 48 may freeze the update of $SE_G(z)$. In some embodiments, whenever the response $SE_G(z)$ is to be updated, smoothing or cross-fading may be applied to transition the response $SE_G(z)$ from its current response to its updated response.

In addition, in some embodiments, secondary path estimate performance monitor 48 may update response $SE_G(z)$ at an update frequency dependent upon a value of SEPI. For example, if SEPI is below a first threshold value, secondary path estimate performance monitor 48 may cause response $SE_G(z)$ to update at a first update frequency. If SEPI is above the first threshold value but below a second threshold value, secondary path estimate performance monitor 48 may cause response $SE_G(z)$ to update at a second update frequency which is lesser than the first update frequency. If SEPI is above the second threshold value, secondary path estimate performance monitor 48 may cause response $SE_G(z)$ to cease updating.

Figure 3D:
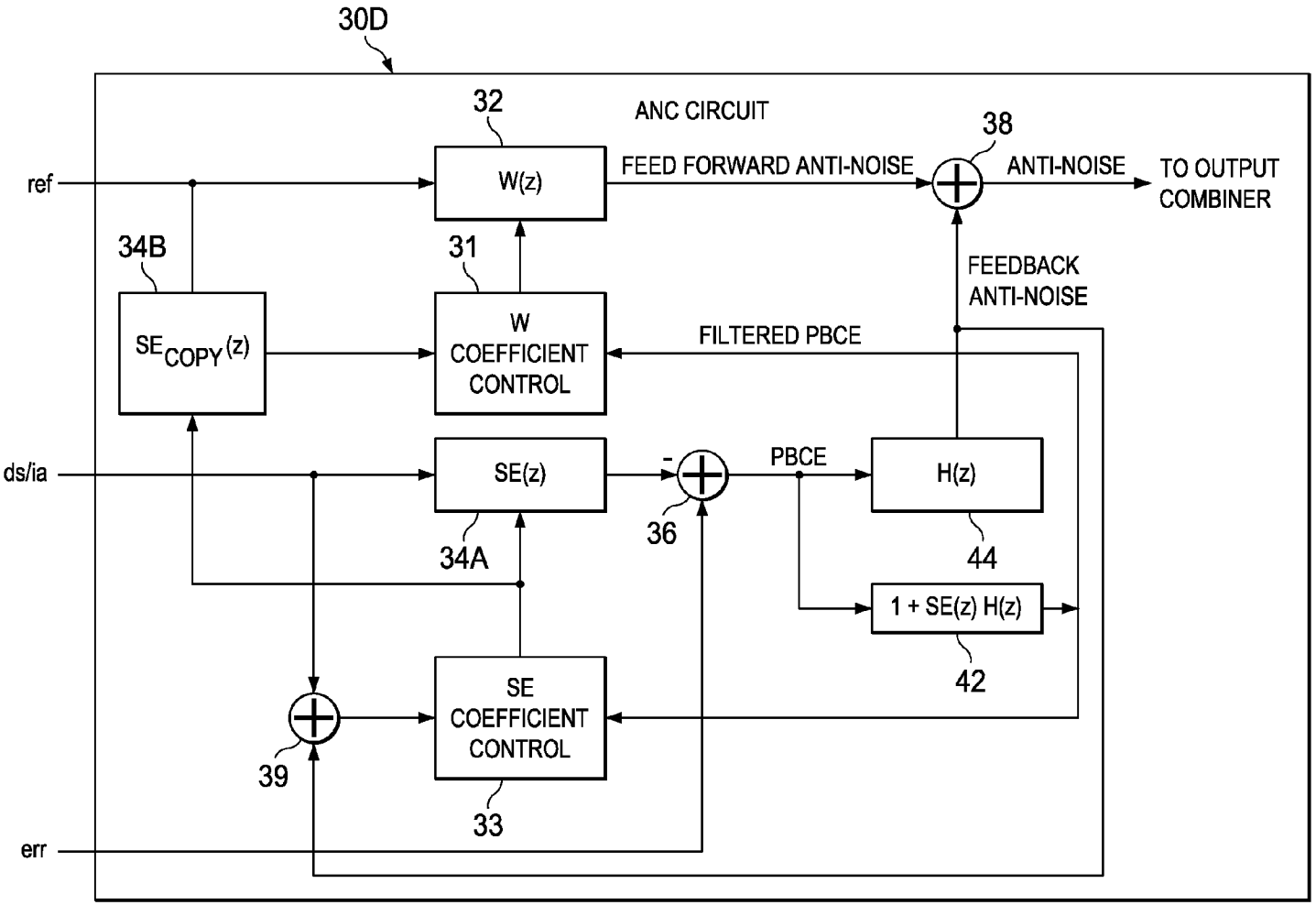

Referring now to FIG. 3D, details of ANC circuit 30D are shown in accordance with embodiments of the present disclosure. ANC circuit 30D may be used in some embodiments to implement ANC circuit 30 depicted in FIG. 2. ANC circuit 30D may be similar in many respects to ANC circuit 30A, thus only the differences between ANC circuit 30D and ANC circuit 30A are discussed.

As depicted in FIG. 3D, instead of SE coefficient control block 33 adaptively updating response SE(z) based on a correlation between a source audio signal (e.g., downlink audio signal ds and/or internal audio signal ia) and the filtered playback corrected error as shown in FIG. 3A, a combiner 39 may combine the source audio signal ds/ia with the feedback anti-noise to generate a modified source audio signal that is communicated to SE coefficient control block 33 such that SE coefficient control block 33 adaptively updates response SE(z) based on a correlation between the modified source audio signal and the filtered playback corrected error. The modified source audio signal $(ds/ia)_{mod}$ may be given by the equation:

$$(ds/ia)_{mod} = (ds/ia)\frac{1 + H(z)SE(z)}{1 + H(z)S(z)}$$

Thus, if secondary response SE(z) closely tracks the actual secondary response S(z), then the modified source audio signal will approximately equal the unmodified source audio signal.

The approach set forth in FIG. 3D may be used in lieu of adjusting gain G as shown in FIGS. 3B and 3C. The approach set forth in FIG. 3D may guarantee phase alignment between reference microphone signal ref and error microphone signal err for the secondary estimate filter 34A, which may in turn assure convergence of the response SE(z) for small step sizes. However, the response SE(z) may be a biased estimation of response S(z) when the signal-to-noise ratio of ANC circuit 30D is low. Accordingly, the approach set forth in FIG. 3D may be best suited for when signal-to-noise ratio is high.

Figure 4:
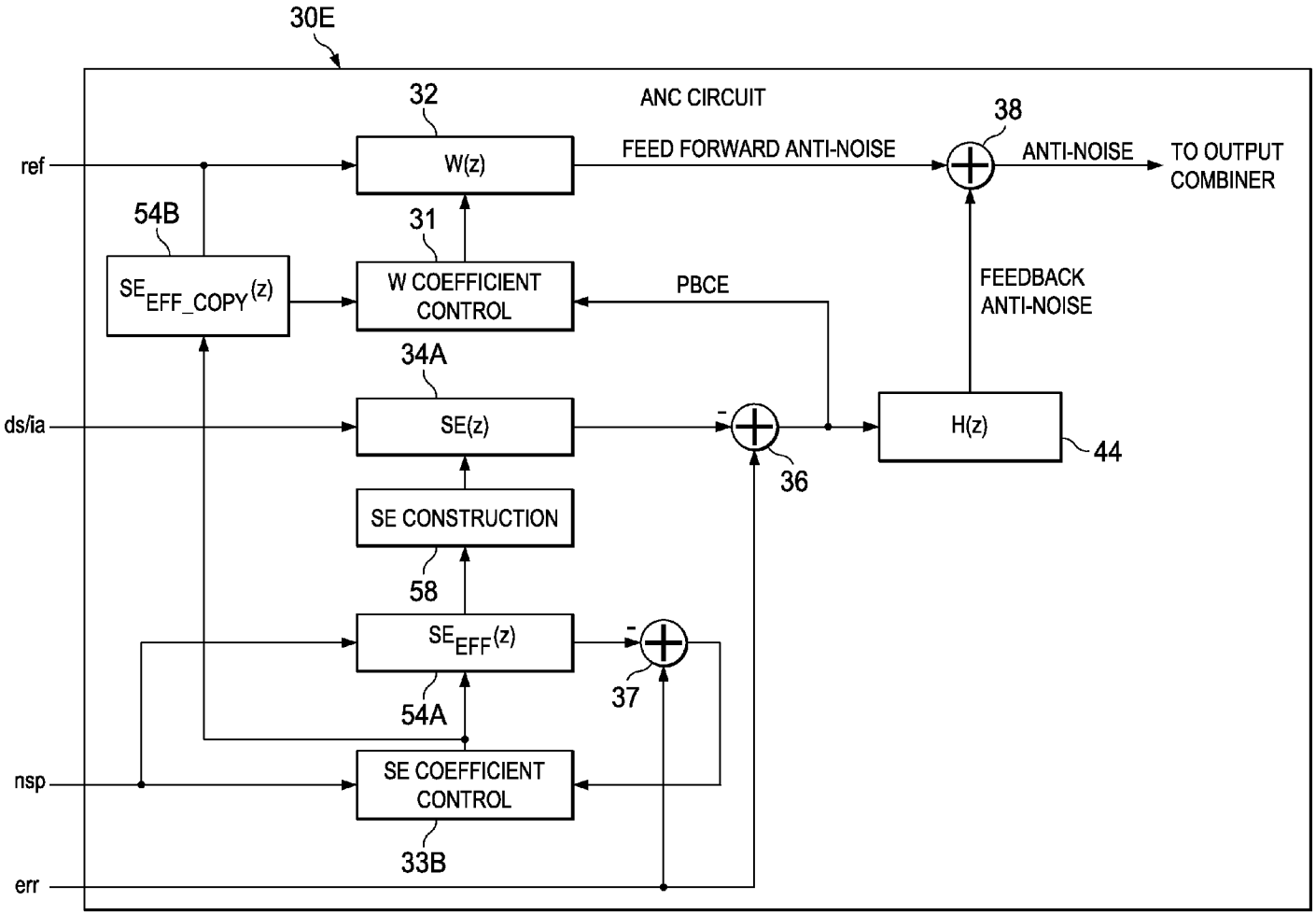
FIG. 4 is a block diagram depicting selected signal processing circuits and functional blocks within an example active noise canceling (ANC) circuit of a coder-decoder (CODEC) integrated circuit of FIG. 2, in accordance with embodiments of the present disclosure.

Referring now to FIG. 4, details of ANC circuit 30E are shown in accordance with embodiments of the present disclosure. ANC circuit 30E may be used in some embodiments to implement ANC circuit 30 depicted in FIG. 2. As shown in FIG. 4, adaptive filter 32 may receive reference microphone signal ref and under ideal circumstances, may adapt its transfer function W(z) to be P(z)/S(z) to generate a feedforward anti-noise component of the anti-noise signal, which may be combined by combiner 38 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. Therefore, response W(z) may be adapted to $P(z)/S_{eff}(z)$ due to the existence of feedback filter 44. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 54B and another signal that includes a playback corrected error signal PBCE which is generated from error microphone signal err. As described previously, an effective secondary path $S_{eff}(z)$ for adaptive filter 32 may be given by $S_{eff}(z)=S(z)/[1+H(z)S(z)]$, and the response of filter 54B may be $SE_{eff_copy}(z)$, which is a copy of a response $S_{eff}(z)$ of an adaptive effective secondary estimate filter 54A, which is described in greater detail below.

By transforming reference microphone signal ref with a copy of the estimate of the effective response of path S(z), response $SE_{eff_COPY}(z)$, and minimizing the ambient audio sounds in the error microphone signal, adaptive filter 32 may adapt to the desired response of $P(z)/S_{eff}(z)$. In addition to error microphone signal err, the signal compared to the output of filter 34B by W coefficient control block 31 may include an inverted amount of downlink audio signal ds and/or internal audio signal is that has been processed by a filter response SE(z). Filter 54B may not be an adaptive filter, per se, but may have an adjustable response that is tuned to match the response of adaptive filter 54A, so that the response of filter 54B tracks the adapting of adaptive filter 54A.

To implement the above, adaptive filter 54A may have coefficients controlled by SE coefficient control block 33B, which may compare an injected, substantially inaudible noise signal nsp and error microphone signal err after removal by combiner 37 of noise signal nsp that has been filtered by adaptive filter 54A having response SE(z) to represent the expected noise signal nsp delivered to error microphone E. Thus, SE coefficient control block 33B may correlate the noise signal nsp with the components of noise signal nsp that are present in error microphone signal err in order to generate response $SE_{eff}(z)$ of adaptive filter 54A to minimize the error microphone signal.

Downlink audio signal ds and/or internal audio signal may be filtered by secondary estimate filter 34A having response SE(z). The filtered downlink audio signal ds and/or internal audio signal may be subtracted from error signal err by a combiner 36 to generate a playback-corrected error (shown as PBCE in FIG. 4).

Furthermore, in order to generate response SE(z) of adaptive filter 34A, an SE construction block 58 may determine response SE(z) from response $SE_{eff}(z)$. For example, SE construction block 58 may calculate response SE(z) in accordance with the following equation:

$$SE(z) = \frac{SE_{eff}(z)}{1 - H(z)SE_{eff}(z)}$$

For example, in order to implement a filter that has a response as in the foregoing equation, one may construct a finite impulse response filter directly using the frequency response of terms on the right side of the equation. As another example, one may construct a filter with such a response using several finite impulse response and/or infinite impulse response blocks.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

an output for providing a signal to a transducer including both a source audio signal for playback to a listener and an anti-noise signal for countering an effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements:

a feedforward filter having a response that generates at least a portion of the anti-noise signal from the reference microphone signal;

a secondary path estimate filter configured to model an electro-acoustic path of the source audio signal and have a response that generates a secondary path estimate from the source audio signal;

a feedback filter having a response that generates at least a portion of the anti-noise signal based on the error microphone signal;

an alignment filter configured to correct misalignment of the reference microphone signal and error microphone signal by generating a misalignment correction signal;

a feedforward coefficient control block that shapes the response of the feedforward filter by adapting the response of the feedforward filter to minimize the ambient audio sounds in the error microphone signal; and a secondary path coefficient control block that shapes the response of the secondary path estimate filter in conformity with the source audio signal and the misalignment correction signal in order to minimize the misalignment correction signal.

2. The integrated circuit of claim 1, wherein the response of the feedback filter generates at least the portion of the anti-noise signal from a playback corrected error, the playback corrected error based on a difference between the error microphone signal and the secondary path estimate.

3. The integrated circuit of claim 2, wherein the misalignment correction signal comprises a filtered playback corrected error generated from the playback corrected error.

4. The integrated circuit of claim 3, wherein the feedforward control block shapes the response of the feedforward filter in conformity with the filtered playback corrected error and the reference microphone signal.

5. The integrated circuit of claim 1, wherein the alignment filter has a response given by $1+SE(z)H(z)$, where $SE(z)$ is the response of the secondary path estimate filter and $H(z)$ is the response of the feedback filter.

6. The integrated circuit of claim 1, wherein the processing circuit further implements a gain associated with the feedback filter.

7. The integrated circuit of claim 6, wherein the processing circuit further implements a secondary path estimate performance monitor for monitoring performance of the secondary path estimate filter in modeling the electro-acoustic path.

8. The integrated circuit of claim 7, wherein the processing circuit controls the gain responsive to the secondary path estimate performance monitor.

9. The integrated circuit of claim 8, wherein the alignment filter has a response given by $1+SE(z)H(z)G$, where $SE(z)$ is the response of the secondary path estimate filter, $H(z)$ is the response of the feedback filter, and G is the gain.

10. The integrated circuit of claim 8, wherein the alignment filter has a response given by $1+SE_G(z)H(z)G$, where $SE_G(z)$ is a previously-stored response of the secondary path estimate filter existing at a time when, as determined by the secondary path estimate performance monitor, the secondary path estimate filter was sufficiently modeling the electro-acoustic path of the source audio signal, $H(z)$ is the response of the feedback filter, and G is the gain.

11. The integrated circuit of claim 10, wherein the secondary path estimate performance monitor updates the stored response $SE_G(z)$ at an update frequency dependent upon a degree of which the secondary path estimate filter is sufficiently modeling the electro-acoustic path of the source audio signal.

12. The integrated circuit of claim 10, wherein a filter having a response substantially equivalent to $SE_G(z)$ is applied to the reference microphone signal to generate a filtered reference microphone signal communicated to the feedforward coefficient control block.

13. The integrated circuit of claim 1, wherein the secondary path coefficient control block shapes the response of the secondary path estimate filter by correlating the misalignment correction signal and a modified source audio signal in order to minimize the misalignment correction signal, wherein the modified source audio signal comprises the sum of the source audio signal and a portion of the anti-noise signal generated by the feedback filter.

14. A method for canceling ambient audio sounds in a proximity of a transducer of a personal audio device, the method comprising:

receiving a reference microphone signal indicative of the ambient audio sounds;

receiving an error microphone signal indicative of the output of the transducer and the ambient audio sounds at the transducer;

generating a source audio signal for playback to a listener;

generating a feedforward anti-noise signal component from the reference microphone signal by adapting a response of an adaptive filter that filters the reference microphone signal to minimize the ambient audio sounds in the error microphone signal;

generating a feedback anti-noise signal component based on the error microphone signal, for countering the effects of ambient audio sounds at an acoustic output of the transducer;

generating a misalignment correction signal to correct misalignment of the reference microphone signal and error microphone signal;

generating the secondary path estimate from the source audio signal by adapting a response of a secondary path estimate filter that models an electro-acoustic path of the source audio signal and filters the source audio signal to minimize the filtered playback corrected error; and combining the feedforward anti-noise signal component and the feedback anti-noise signal component with a source audio signal to generate an audio signal provided to the transducer.

15. The method of claim 14, wherein generating the feedback anti-noise signal component comprises filtering a playback corrected error with a feedback filter, the playback corrected error based on a difference between the error microphone signal and a secondary path estimate.

16. The method of claim 15, wherein generating the misalignment correction signal comprises generating a filtered playback corrected error from the playback corrected error.

17. The method of claim 16, wherein adapting the response of an adaptive filter that filters the reference microphone signal comprises shaping the response of the adaptive filter in conformity with the filtered playback corrected error and the reference microphone signal.

18. The method of claim 14, wherein the alignment filter has a response given by $1+SE(z)H(z)$, where $SE(z)$ is the response of the secondary path estimate filter and $H(z)$ is the response of the feedback filter.

19. The method of claim 14, further comprising applying a gain associated with the feedback filter.

20. The method of claim 19, further comprising monitoring with a secondary path estimate performance to monitor performance of the secondary path estimate filter in modeling the electro-acoustic path.

21. The method of claim 20, further comprising controlling a gain of the gain element responsive to the secondary path estimate performance monitor.

22. The method of claim 20, wherein the alignment filter has a response given by $1+SE(z)H(z)G$, where $SE(z)$ is the response of the secondary path estimate filter, $H(z)$ is the response of the feedback filter, and G is the gain.

23. The method of claim 20, wherein the alignment filter has a response given by $1+SE_G(z)H(z)G$, where $SE_G(z)$ is a previously-stored response of the secondary path estimate filter existing at a time when, as determined by the secondary path estimate performance monitor, the secondary path estimate filter was sufficiently modeling the electro-acoustic path of the source audio signal, $H(z)$ is the response of the feedback filter, and G is the gain.

24. The method of claim 23, further comprising updating the stored response $SE_G(z)$ at an update frequency dependent upon a degree of which the secondary path estimate filter is sufficiently modeling the electro-acoustic path of the source audio signal.

25. The method of claim 23, further comprising applying a filter having a response substantially equivalent to $SE_G(z)$ to the reference microphone signal to generate a filtered reference microphone signal communicated to the feedforward coefficient control block.

26. The method of claim 14, wherein the secondary path coefficient control block shapes the response of the secondary path estimate filter by correlating the misalignment correction signal and a modified source audio signal in order to minimize the misalignment correction signal, wherein the modified source audio signal comprises the sum of the source audio signal and a portion of the anti-noise signal generated by the feedback filter.

27. An integrated circuit for implementing at least a portion of a personal audio device, comprising:

an output for providing a signal to a transducer including both a source audio signal for playback to a listener and an anti-noise signal for countering an effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer;

a noise input for receiving an injected, substantially inaudible noise signal; and a processing circuit that implements:

a feedforward filter having a response that generates at least a portion of the anti-noise signal from the reference microphone signal;

a secondary path estimate filter configured to model an electro-acoustic path of the source audio signal and have a response that generates a secondary path estimate from the source audio signal;

a feedback filter having a response that generates at least a portion of the anti-noise signal based on the error microphone signal;

an effective secondary estimate filter configured to model an electro-acoustic path of the anti-noise signal and have a response that generates a filtered noise signal from the noise signal;

a feedforward coefficient control block that shapes the response of the feedforward filter in conformity with the error microphone signal and the reference microphone signal by adapting the response of the feedforward filter to minimize the ambient audio sounds in the error microphone signal;

a secondary path coefficient control block that shapes the response of the effective secondary path estimate filter in conformity with the noise signal and the error microphone signal in order to minimize the error signal; and a secondary estimate construction block that generates the response of the secondary estimate filter from the response of the effective secondary estimate filter.

28. The integrated circuit of claim 27, wherein the secondary estimate construction block generates the response of the secondary estimate filter from the response of the effective secondary estimate filter in accordance with the equation:

$$SE(z) = \frac{SE_{eff}(z)}{1 - H(z)SE_{eff}(z)}$$

where SE(z) is the response of the secondary estimate filter, $SE_{eff}(z)$ is the response of the effective secondary estimate filter, and H(z) is the response of the feedback filter.

29. The integrated circuit of claim 27, wherein the response of the feedback filter generates at least the portion of the anti-noise signal from a playback corrected error, the playback corrected error based on a difference between the error microphone signal and a sum of the secondary path estimate and a filtered noise signal.

30. A method for canceling ambient audio sounds in the proximity of a transducer of a personal audio device, the method comprising:

receiving a reference microphone signal indicative of the ambient audio sounds;

receiving an error microphone signal indicative of an output of the transducer and the ambient audio sounds at the transducer;

generating a source audio signal for playback to a listener;

generating a feedforward anti-noise signal component from the reference microphone signal by adapting a response of an adaptive filter that filters the reference microphone signal to minimize the ambient audio sounds in the error microphone signal;

generating a feedback anti-noise signal component based on the error microphone signal;

generating the filtered noise signal from a noise signal by adapting a response of an effective secondary path estimate filter that models an electro-acoustic path of the anti-noise signal and filters the noise signal to minimize the error microphone signal;

generating the secondary path estimate from the source audio signal by applying a response of a secondary path estimate filter wherein the response of the secondary estimate filter is generated from the response of the effective secondary estimate filter; and combining the feedforward anti-noise signal component and the feedback anti-noise signal component with a source audio signal to generate an audio signal provided to the transducer.

31. The method of claim 30, wherein a secondary estimate construction block generates the response of the secondary estimate filter from the response of the effective secondary estimate filter in accordance with the equation:

$$SE(z) = \frac{SE_{eff}(z)}{1 - H(z)SE_{eff}(z)}$$

where SE(z) is the response of the secondary estimate filter, $SE_{eff}(z)$ is the response of the effective secondary estimate filter, and H(z) is the response of the feedback filter.

32. The method of claim 30, wherein generating the feedback anti-noise signal component comprises filtering a playback corrected error with a feedback filter, the playback corrected error based on a difference between the error microphone signal and a sum of a secondary path estimate and a filtered noise signal.

* * * * *